United States Patent [19]

Meijer et al.

[11] 4,384,180

[45] May 17, 1983

[54] ELECTRIC SHAVER HAVING PLURAL SWITCH ASSEMBLY AND ILLUMINATED COUNTER MECHANISM

[75] Inventors: Gerald Meijer; Mosayoshi Takaoka; Koichi Hayashi, all of Suita, Japan

[73] Assignee: U.S. Philips Corporation, New York, N.Y.

[21] Appl. No.: 270,666

[22] Filed: Jun. 4, 1981

[30] Foreign Application Priority Data

Jul. 17, 1980 [NL] Netherlands ..... 8004115

[51] Int. Cl.[3] ..... H01H 35/00; B26B 19/02; H01H 19/14

[52] U.S. Cl. ..... 200/52 R; 200/156; 200/308; 200/316; 30/DIG. 1

[58] Field of Search ..... 200/52 R, 308, 316, 200/156

[56] References Cited

U.S. PATENT DOCUMENTS

| | | | |
|---|---|---|---|
| 3,176,106 | 3/1965 | Van Den Driest | 200/308 |
| 3,328,542 | 6/1967 | Andrews | 200/52 R |
| 3,349,211 | 10/1967 | Lien | 200/316 |
| 3,803,372 | 4/1974 | Dijkstra | 200/52 R |
| 4,112,271 | 9/1978 | Marchetti | 200/52 R |

*Primary Examiner*—J. R. Scott

*Attorney, Agent, or Firm*—Thomas A. Briody; William J. Streeter; Rolf E. Schneider

[57] ABSTRACT

There is provided a battery-operated electrical appliance such as an electric shaver including a mechanism for counting the number of times the appliance is operated. A first switch for activating the appliance is positioned in the mechanism housing, together with a rotatably mounted member provided with indicia for indicating the number of times the first swtich has been operated. An actuating member brings the movable contact and the fixed contact of the first switch into and out of engagement with each other, the actuating member including an element for engagement with the indicating member to successively rotate the same one indicia unit each time the first switch is actuated. A second switch is associated in the housing with the indicating member and has a movable contact and a fixed contact arranged to be brought into engagement after a predetermined number of successive partial rotations of the indicating member. An indicator lamp is activated by the second switch, the indicator lamp being deactivated each time the contacts of the first switch are disengaged.

3 Claims, 5 Drawing Figures

ELECTRIC SHAVER HAVING PLURAL SWITCH ASSEMBLY AND ILLUMINATED COUNTER MECHANISM

BACKGROUND OF THE INVENTION

This invention relates to an electrical appliance, for example an electric shaver, with a built-in power source, which appliance is provided having a switch with an actuating element coupled to a counting mechanism.

Such an appliance is for example known from U.S. Pat. No. 3,803,372. The counting mechanism of this appliance is provided with a counting element on which the number of switching actions can be read. However, the number of switching actions is not a perfect criterion for determining the moment at which the power source is to be replaced or recharged.

It is the object of the invention to provide an improved indication of such time, and the invention is characterized in that the counting mechanism is provided with a second switch for an indicator lamp. Generally, a lit indicator lamp is more conspicuous than a number on a counting element, while moreover the light emitted by the indicator lamp may serve as a measure of the condition of the power source.

A special embodiment in which the counting mechanism is provided with a rotary disc with digits is characterized in that the indicator lamp is situated at least partly in a central recess of the disc. Such an embodiment, in which the counting mechanism is provided with a base plate which rotatably supports the rotary disc, is characterized in that a slip-contact member is connected to the disc and the base plate is provided with a complementary fixed contact member.

The invention is also embodied in a counting mechanism as used in such an electrical appliance

BRIEF DESCRIPTION OF THE DRAWINGS

The invention will now be described in more detail with reference to the accompanying drawings in which.

BRIEF DESCRIPTION OF THE PREFERRAL EMBODIMENTS

Figure 1:
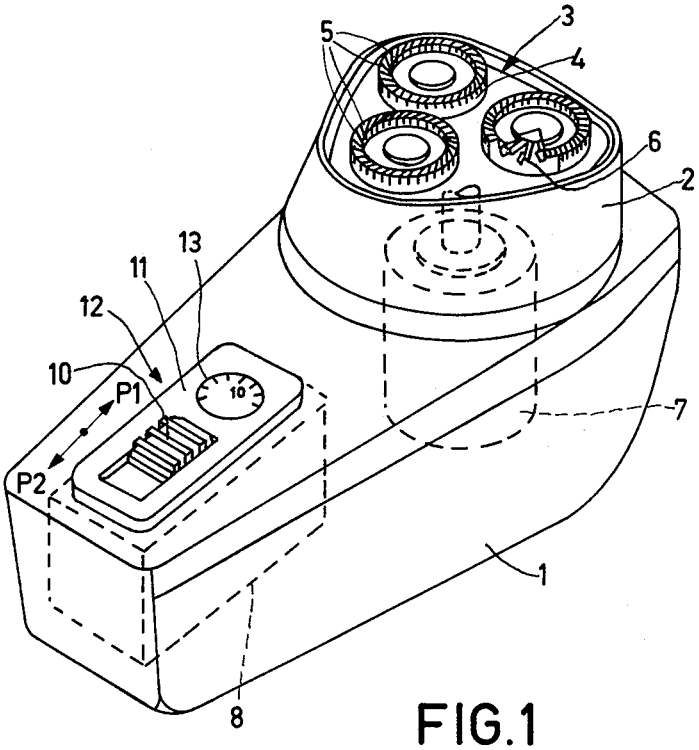
FIG. 1 is a perspective view of a shaver.
Figure 2:
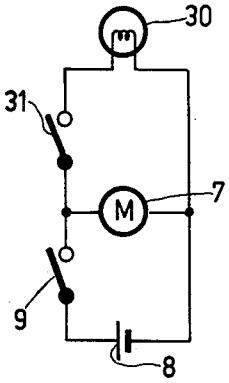
FIG. 2 is a circuit diagram of the power supply of the shaver of FIG. 1.

The shaver of FIG. 1 comprises a housing 1 with a shaving head 2 comprising three shaving units 3. Each shaving unit comprises a stationary shear plate 4 with hair entry apertures 5 and a rotatable cutter 6. The cutters are driven by an electric motor 7, which is powered by a builtin power source 8. Both the motor 7 and the power source 8 are accommodated in the housing 1. The motor 7 can be switched on and off by means of a switch 9 (see FIG. 2). The power source 8 may for example comprise one or more batteries, but it is alternatively possible to employ other power sources, such as a rechargeable nickel-cadmium accumulator battery.

The switch 9 is provided with an actuating element 10, which is located in the wall 11 of the counting mechanism 12 and which can be respectively slid into two positions in the directions $P_1$ and $P_2$. The wall 11 also contains a window 13 behind which a disc 14 with the digits or indicia of the counting mechanism 12 is visible.

Figure 3:
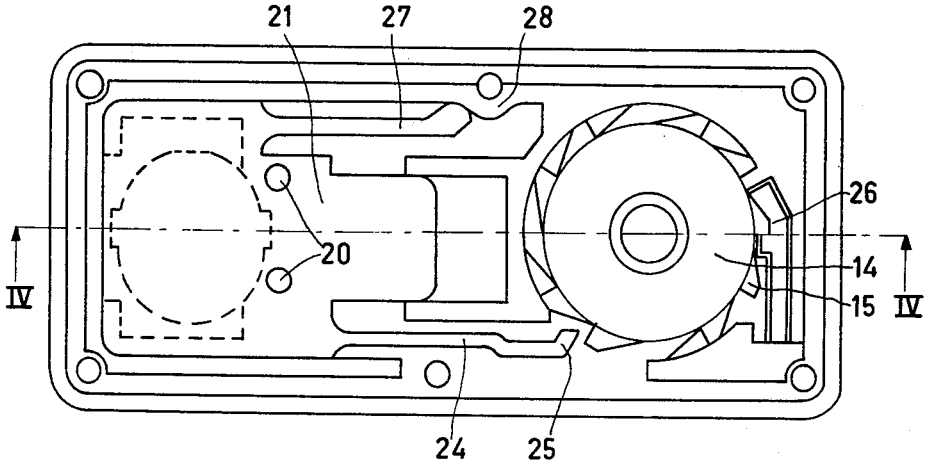
FIG. 3, on an enlarged scale, shows a plan view of the counting mechanism of the shaver of FIGS. 1 and 2.
Figure 4:
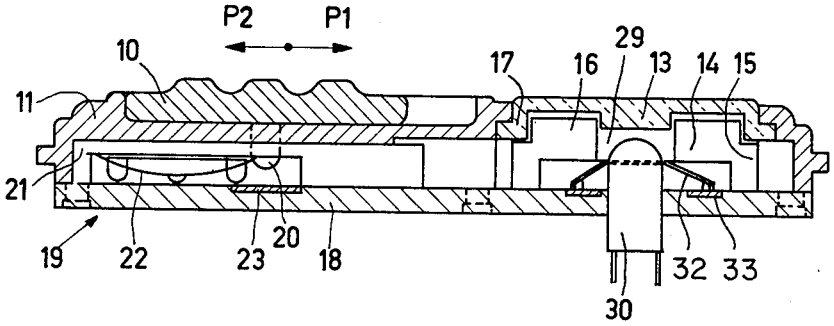
FIG. 4 is a sectional view taken on the line IV—IV in FIG. 3.

The counting mechanism 12 is shown on an enlarged scale in FIGS. 3 and 4 and comprises the disc 14 having circumferential teeth 15. The disc 14 has a non-toothed cylindrical portion 16, which is mounted for rotation in a corresponding cylindrical portion 17 of the wall 11. Moreover, the disc 14 is supported by a base plate 18, which is spaced from the wall 11 and together with the wall 11 constitutes a housing 19 enclosing the disc 14. Via the window 13 the number of switching cycles of the switch 9 can be read.

Figure 5:
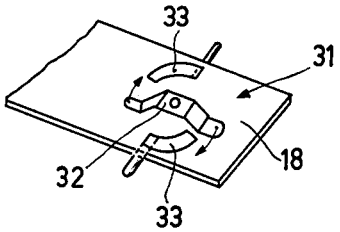
FIG. 5 is a perspective view of a detail of the counting mechanism of FIGS. 3 and 4.

By means of the pins 20 the actuating element is coupled to the slide 21 mode of an insulating material, which slide is also located in the housing 19. The slide is provided with a movable or sliding contact member 22, which when the actuating element 10 is slid in the direction $P_1$ makes contact with the contact fixed strips 23 on the base plate 18, so that the switch 9 is closed. The slide 21 is provided with a first resilient arm or element 24, whose end 25 engages with a tooth 15 of the disc 14 when the actuating element is slid in the direction $P_1$, so that the disc is rotated. The pawl 26 prevents the disc 14 from rotating back when the actuating element 10 is slid in the direction $P_2$ in order to switch off the motor 7. A second resilient arm 27 on the slide 21 engages with the inclined surfaces of a cam 28 in the two end positions, so that the slide is fixed in these positions. In a central aperture 29 of the disc 14 an indicator lamp 30 is situated. As the indicator lamp 30 is situated directly behind the window 13, the light emitted by the lamp is well visible. The indicator lamp 30 is switched on by means of a second switch 31, of which a movable slip-contact member 32 is secured to the disc 14 (FIG. 5), while stationary or fixed contact members 33 are arranged on the base plate. After a predetermined or selected number of switching cycles of the switch 9, the disc 14 being rotated through a corresponding angle, the slip contact member 32 will come into contact with the contact members 33, thereby closing the switch 31. The indicator lamp 31 will thereafter light up each time that the switch 9 is closed. In this way an extra indication is obtained if the batteries of power source 8 are to be replaced or if the power source 8 is to be recharged. Moreover, since the light emitted by the indicator lamp 30 after an increasing number of switching cycles grows fainter, a further indication is obtained.

By arranging the indicator lamp 30 to be concentric with the disc 14, a very flat construction of the counting mechanism can be obtained.

The construction of the counting mechanism may also be employed in other appliances, such as flashlights, flash units, audio and video equipment.

What is claimed is:

1. A battery-operated electrical appliance such as an electric shaver which includes a mechanism for counting the number of times said appliance is operated, said counting mechanism comprising a housing formed by a base plate and a spaced-apart wall; a first switch for activating the appliance positioned in said housing and having a movable contact and a fixed contact; a member provided with indicia for indicating the number of times said first switch has been operated and rotatably mounted in said housing; an actuating member for bringing said movable contact and said fixed contact of said first switch into and out of engagement with each other, said actuating member including an element for engagement with said indicating member to successively rotate the same one indicia unit each time said first switch is actuated; a second switch associated in the housing with the indicating member and having a movable contact and a fixed contact arranged to be brought into engagement after a predetermined number of successive partial rotations of said indicating member; and an indicator lamp activated by said second switch, said indicator lamp being de-activated each time the contacts of the first switch are disengaged.

2. An electrical appliance according to claim 1, in which the indicating member comprises a rotary disc having a central aperture, the indicator lamp being situated in said aperture.

3. An electrical appliance according to claim 2, in which the movable contact of the second switch is attached to the rotary disc, and the fixed contact of said second switch is connected to the base plate.

* * * * *